United States Patent [19]

Santucci et al.

[11] 4,071,053

[45] Jan. 31, 1978

[54] DEVICE FOR THE FORMATION OF THE SHED IN A MULTISHED LOOM

[75] Inventors: Nicola Santucci, Schio (Vicenza), Italy; Zabotin Aleksandr Aleksandrovic; Loschilin Evghenii Dmitrievich; Galperin Aleksandr Lvovich; Onikov Eduard Archakovich, all of Moscow, U.S.S.R.

[73] Assignee: Nuovo Pignone S.p.A., Italy

[21] Appl. No.: 728,239

[22] Filed: Sept. 30, 1976

[30] Foreign Application Priority Data

Oct. 3, 1975 Italy ..... 27954/75

[51] Int. Cl.[2] ..... D03D 47/26; D03C 5/00; D03C 13/00

[52] U.S. Cl. ..... 139/436; 139/55.1; 139/79

[58] Field of Search ..... 139/55–58, 139/79–82, 91, 92, 436

[56] References Cited

U.S. PATENT DOCUMENTS

| | | | |
|---|---|---|---|
| 2,263,678 | 11/1941 | Cosman | 139/79 |
| 3,695,304 | 10/1972 | Menegatto | 139/79 X |
| 3,739,816 | 6/1973 | Kramenic et al. | 139/436 |
| 3,831,638 | 8/1974 | Selivanov et al. | 139/79 X |
| 3,866,634 | 2/1975 | Rutkevich et al. | 139/79 |
| 3,949,788 | 4/1976 | Speich | 139/79 X |

FOREIGN PATENT DOCUMENTS

| | | | |
|---|---|---|---|
| 1,072,569 | 12/1959 | Germany | 139/436 |

*Primary Examiner*—James Kee Chi
*Attorney, Agent, or Firm*—Morgan, Finnegan, Pine, Foley & Lee

[57] ABSTRACT

In a shed-forming device for a loom which simultaneously weaves a number of fabric lengths and in which heald-moving cams are arranged along a helical path, the improvement of providing couples of matched levers which are not bound to each other, and wherein one lever is controlled by a cam and the other lever is controlled by a spring, so that said levers are kept in a contrasting or opposing relationship by the control mechanisms.

3 Claims, 1 Drawing Figure

DEVICE FOR THE FORMATION OF THE SHED IN A MULTISHED LOOM

Figure 1:
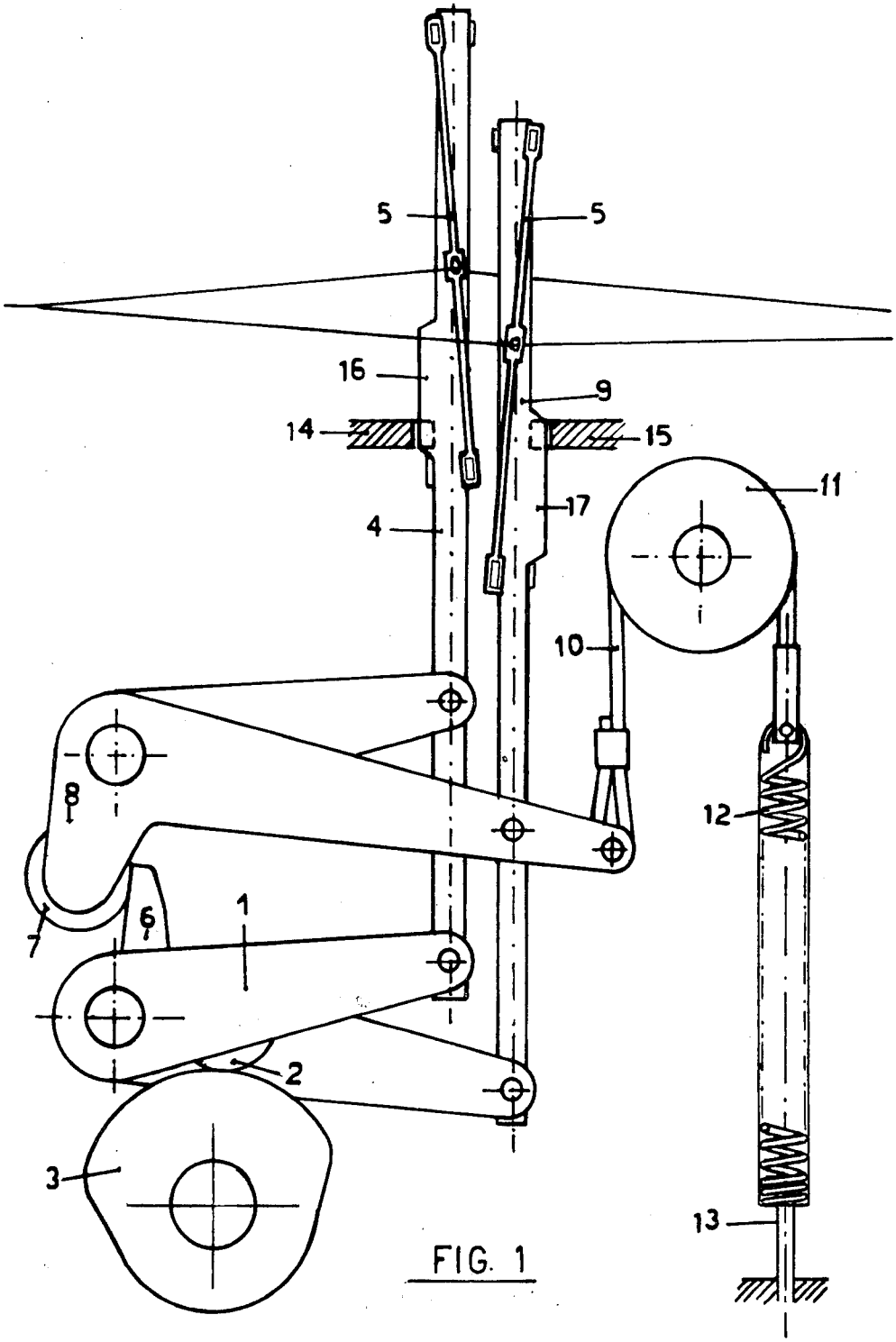

This invention relates to a device for forming the shed in multished weaving machines.

In multished loom a plurality of wefts are simultaneously inserted weft-carriers which follow one another in the warp at preselected distances. The shed of each row (or frame) of healds is shaped according to a set of sheds, called therefor undulating shed, each of which is open on each weft-carrier and in motion therewith. For the satisfactory operation of multished looms, the movement of the heald should take place within very short intervals of time. This therefore results in very high accelerations and inertial forces, so that, even with the heald rows divided into very small sections, the movable members should have to be appropriately sized and stiff, In turn, this creates a number of constructional and operational problems.

A number of control devices for the formation of the undulating shed are known. These devices are based on the use of a camshaft carrying a set of cams, arranged on a helical line with the helical pitch being a function of the weft-carrying distance. These cams actuate a set of mechanisms which impart to the healds the motion for the formation of the undulating shed.

In one of these devices, the healds are arranged on rods which are driven by levers, that are pivoted at either end and controlled by a set of collar-shaped eccentrics.

This arrangement, imparts a sinusuidal configuration and trend to the wave being translated, these features These features have an unfavorable influence on the operation of the mechanism: which is required to give a waveform that affords a wide space to the moving weft-carrier that is a waveform which is composed, at every instant of time, by a redundance of motionless sections as compared with the sections which are in motion.

Another arrangement provides for a helical sequence of cams each of which controls two feelers, which are mounted so as to face each other. Each, couple alternatingly drives a lever connected at either end to an intermediate point of a second lever, which is swung about a position that is roughly perpendicular to the first lever.

This second lever, one end of which can be shifted so as to obtain the adjustment of the shed, transfers its reciprocal motion to two additional levers, which are connected to each other by a link. The levers, in turn, impart a reciprocal motion to the two heald-carrying beams for the formation of the undulating shed.

Such an arrangement is correct from a mechanical standpoint in, addition, it permits a few adjustments in operations to be carried out. However, it has a serious defect in that, due to the large number of component parts, there are a number of clearances in the construction. Further this arrangement produces considerable masses in motion which, create very heavy stresses as it is subject to substantial acceleration. All these facts are conducive to an extremely rapid wear of the mechanism.

This invention is directed to overcoming the foregoing defects by providing a mechanism which is simple and easy to assemble and is capable of taking up all the clearances originated by the construction to limit wear.

In order to obtain the translating wave referred to above, the device of the invention includes two levers which are used in each section, These levers are not necessarily bound to each other, and each lever controls either heald-carrying beam which are placed in an advanced position in the respective rows. One of these levers is controlled by a cam by a feeler wheel, and the other of these levers is negatively controlled by a pull string. The two levers are not bound to each other, but they work in mutual contrast by means of any arrangement which, mininizes friction in effecting such contrast. Each heald-carrying beam, then, is maintained in the vertical position by a second lever which makes up, in union with the first, a parallelogram system, and also by a specially provided guide arranged beneath the warp threads acting upon a component part which has been specially provided on the heald-carrying beam.

The present invention will be better understood from the following illustrative embodiment of the invention, wherein:

FIG, 1 is a schematic view of the preferred embodiment of the invention showing that the device is one plane.

The lever 1, which carries the feeler 2, is driven by the cam 3 and transfers the drive to the beam 4 which carries a part of the healds 5 of the section. Concurrently, a dog 6 of the lever 1 abuts the follower wheel 7 of the lever 8. The latter, by being moved downwards, drags with itself the rod 9 which moves the remaining healds of the section. The beams 4 and 9 slide in the guides 14 and 15 by means of the projections 16 and 17. A part of the healds of the section is moved upwards and the remaining part downward, thus providing the shed. The lever 8 drags with itself also the cable 10 and the latter, rotated over the pulley 11 pulls the spring 12, which can be adjusted by means of the spring-stretcher 13 so as to be adapted to the several speeds of the mechanism. When the follower 2 of the lever 1 begins to go down by following the profile of the cam 3, the lever 8, acting against the aforesaid lever 1, can rise and release the spring 12. Consequently, the levers 1 and 8 reverse their positions by exploiting the contrast between the dog 6 and the follower 7 and thus the beams 4 and 9 invert their positions and so do the healds carried thereby and these latter, by moving their respective threads, provide a new shed for the next incoming weft carrier.

What I claim is:

1. A device for the formation of the shed in a multished loom having a shaft on which cams are mounted in a cylindrical helix array, said cams being the motive member of the mechanism which has as its purpose to drive the beams carrying the healds which displace the warp threads to obtain the formation of the shed, wherein said device is in one place and includes: matched levers which are separated from each other, cam means connected to one of said levers for controlling the same, spring means operatively connected to the other of said levers for controlling the same, said levers being maintained in opposing relationship to each other by said cam and spring means, flexible means interconnecting said spring means and said other lever, and guides positioned beneath the warp threads which operatively cooperate with the healds to give stability to the heald-carrying beams.

2. A device according to claim 1, wherein said flexible means includes a flexible member connected to said spring and said other lever, and a pulley over which said flexible member slides.

3. A device according to claim 1, wherein the heald-carrying beams include portions upon which said guides act and without disturbing the healds, said guides being arranged beneath the shed plane so as to allow the weaver access to the threads.

* * * * *

UNITED STATES PATENT AND TRADEMARK OFFICE

CERTIFICATE OF CORRECTION

PATENT NO. : 4,071,053
DATED : January 31, 1978
INVENTOR(S) : Nicola Santucci, et al It is certified that error appears in the above-identified patent and that said Letters Patent are hereby corrected as shown below:

Column 1, line 7, Correct "loom" to read --looms--.

line 8, After "inserted" insert --by--.

line 11, Correct "therefor" to read --the--.

line 14, After "This" delete --therefore--.

line 18, After "stiff" change the comma "," to a period --.--.

line 31, After "arrangement" delete the comma --,-- and correct spelling of "sinusoidal".

UNITED STATES PATENT AND TRADEMARK OFFICE

CERTIFICATE OF CORRECTION

PATENT NO. : 4,071,053
DATED : January 31, 1978
INVENTOR(S) : Nicola Santucci, et al It is certified that error appears in the above-identified patent and that said Letters Patent are hereby corrected as shown below:

Column 1, line 32, After "translated" delete ", these features".

line 34, After "mechanism" delete the colon ":".

line 36, After "carrier" insert a comma --,--.

line 40, Before "couple" delete the comma ",".

line 52, After "standpoint" delete "in," and insert --. In--.

line 57, After "which" delete the comma ",".

line 58, Correct "subject" to read --subjected--.

line 66, After "section" change the comma "," to a period --.--.

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,071,053

DATED : January 31, 1978

INVENTOR(S) : Nicola Santucci et al

It is certified that error appears in the above-identified patent and that said Letters Patent are hereby corrected as shown below:

On the cover sheet Item (73) should read

-- Assignees: Nuovo Pignone S.P.A. and Znikhbi: Tsentralny Nauchne-issledevatelsky institut khlopehatobumezhnoi promyshlennesti --.

Signed and Sealed this

*First* Day of *May 1979*

[SEAL]

*Attest:*

RUTH C. MASON
*Attesting Officer*

DONALD W. BANNER
*Commissioner of Patents and Trademarks*